US009597887B2

(12) United States Patent
Gonzales et al.

(10) Patent No.: US 9,597,887 B2
(45) Date of Patent: Mar. 21, 2017

(54) PEN HOUSINGS

(71) Applicant: Hewlett-Packard Development Company, L.P., Houston, TX (US)

(72) Inventors: Curt Gonzales, Corvallis, OR (US); Ralph L. Stathem, Lebanon, OR (US); David N. Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/084,348

(22) Filed: Mar. 29, 2016

(65) Prior Publication Data

US 2016/0207324 A1 Jul. 21, 2016

Related U.S. Application Data

(63) Continuation of application No. 14/001,142, filed as application No. PCT/US2011/027229 on Mar. 4, 2011, now Pat. No. 9,321,275.

(51) Int. Cl.
*B41J 2/175* (2006.01)
*B41J 2/19* (2006.01)

(52) U.S. Cl.
CPC ..... *B41J 2/17563* (2013.01); *B41J 2/17509* (2013.01); *B41J 2/17513* (2013.01); *B41J 2/17556* (2013.01); *B41J 2/17596* (2013.01); *B41J 2/19* (2013.01); *B41J 2/175* (2013.01)

(58) Field of Classification Search
CPC ..... B41J 2002/14403; B41J 2/17563; B41J 2/17596; B41J 2/19; B41J 2202/07
See application file for complete search history.

(56) References Cited

U.S. PATENT DOCUMENTS

| | | | |
|---|---|---|---|
| 6,050,682 | A | 4/2000 | Pawlowski, Jr. et al. |
| 6,270,211 | B1 | 8/2001 | Long et al. |
| 7,819,515 | B2 | 10/2010 | Silverbrook et al. |
| 8,480,214 | B2 | 7/2013 | Tsubaki |
| 2002/0167571 | A1 | 11/2002 | Hayashi et al. |
| 2003/0038865 | A1 | 2/2003 | Inamura |

(Continued)

FOREIGN PATENT DOCUMENTS

| | | |
|---|---|---|
| CN | 101861246 | 10/2010 |
| JP | 2006224312 | 8/2006 |

(Continued)

OTHER PUBLICATIONS

Patent Cooperation Treaty, "International Preliminary Report on Patentability", issued in connection with PCT Patent Application No. PCT/US2011/027229, issued on Sep. 10, 2013, 5 pages.

(Continued)

*Primary Examiner* — Julian Huffman
(74) *Attorney, Agent, or Firm* — Hanley Flight & Zimmerman, LLC

(57) ABSTRACT

An example pen housing includes a first regulator to actuate in response to a first pressure change to enable gas within a first chamber to flow from the first chamber to a second chamber, the first chamber to flow ink to a printhead, the second chamber not to receive ink directly from an ink supply; and a second regulator to actuate in response to a second pressure change to enable the gas received from the first chamber to be discharged from the second chamber.

20 Claims, 9 Drawing Sheets

(56) References Cited

U.S. PATENT DOCUMENTS

| | | | | |
|---|---|---|---|---|
| 2003/0202057 | A1* | 10/2003 | Childs | B41J 2/175 347/85 |
| 2003/0202072 | A1* | 10/2003 | Childs | B41J 2/175 347/89 |
| 2005/0264626 | A1 | 12/2005 | Childs et al. | |
| 2006/0033791 | A1 | 2/2006 | Suzuki et al. | |
| 2006/0132554 | A1 | 6/2006 | Ota et al. | |
| 2006/0187278 | A1 | 8/2006 | Langford et al. | |
| 2007/0052775 | A1 | 3/2007 | Jung | |
| 2008/0043076 | A1 | 2/2008 | Coffey et al. | |
| 2008/0297546 | A1 | 12/2008 | Lee et al. | |
| 2009/0009569 | A1 | 1/2009 | Sasaki | |
| 2009/0027461 | A1 | 1/2009 | Asada | |
| 2009/0267976 | A1 | 10/2009 | Lee et al. | |
| 2010/0053285 | A1 | 3/2010 | Ito | |
| 2010/0194830 | A1 | 8/2010 | Yoshiike | |
| 2010/0201759 | A1 | 8/2010 | Kawase et al. | |
| 2010/0289856 | A1 | 11/2010 | Yamamoto et al. | |
| 2012/0075390 | A1 | 3/2012 | Park et al. | |
| 2013/0335493 | A1 | 12/2013 | Gonzales et al. | |

FOREIGN PATENT DOCUMENTS

| | | |
|---|---|---|
| KR | 20020049716 | 6/2002 |
| TW | 200924987 | 6/2009 |

OTHER PUBLICATIONS

Patent Cooperation Treaty, "International Search Report", issued in connection with PCT Patent Application No. PCT/US2011/027229, issued on Nov. 25, 2011, 3 pages.

Patent Cooperation Treaty, "Written Opinion", issued in connection with PCT Patent Application No. PCT/US2011/027229, issued on Nov. 25, 2011, 4 pages.

United States Patent and Trademark Office, "Notice of Allowance", issued in connection with U.S. Appl. No. 14/001,142, mailed on Dec. 21, 2015, 14 pages.

United States Patent and Trademark Office, "Non-Final Office Action", issued in connection with U.S. Appl. No. 14/001,142, mailed on Oct. 8, 2015, 23 pages.

United States Patent and Trademark Office, "Final Office Action", issued in connection with U.S. Appl. No. 14/001,142, mailed on May 8, 2015, 25 pages.

United States Patent and Trademark Office, "Non-Final Office Action", issued in connection with U.S. Appl. No. 14/001,142, mailed on Oct. 8, 2014, 30 pages.

State Intellectual Property Office of the People's Republic of China, "Office Action", issued in connection with Chinese Patent Application 201180068981.8, issued on Nov. 4, 2011, 7 pages.

State Intellectual Property Office of the People's Republic of China, "Notification to Grant Patent Right for Invention", issued in connection with Chinese Patent Application 201180068981.8, issued on Sep. 2, 2015, 5 pages.

* cited by examiner

PEN HOUSINGS

RELATED APPLICATIONS

This patent arises from a continuation of U.S. patent application Ser. No. 14/001,142, filed Aug. 22, 2013, which is a U.S. national stage of PCT Application Serial No. PCT/US2011/027229, filed Mar. 4, 2011. Priority is claimed to U.S. patent application Ser. No. 14/001,142 and PCT Application Serial No. PCT/US2011/027229. U.S. patent application Ser. No. 14/001,142 and PCT Application Serial No. PCT/US2011/027229 are hereby incorporated herein by reference in their entireties.

BACKGROUND

Fluid ejection systems employ a print head having print nozzles to expel fluid droplets onto print media, which dry to form images. To provide ink to the print nozzles, an ink reservoir or supply is fluidly coupled to the print head. To reduce operating costs, some fluid ejection systems employ an ink supply that is separately replaceable so that the print head is not discarded when an ink supply is depleted. However, fluid ejection systems having replaceable ink supplies may be susceptible to excessive air or gas accumulation within the fluid ejection system (e.g., a chamber adjacent the print nozzles). Excessive air or gas accumulation may affect printing quality, may cause print drool through the print nozzles and/or shorten the operational life of the print nozzles. To purge excessive air or gas that may accumulate within a fluid ejection system, the fluid ejection system may employ an air management system.

DETAILED DESCRIPTION

Figure 1:
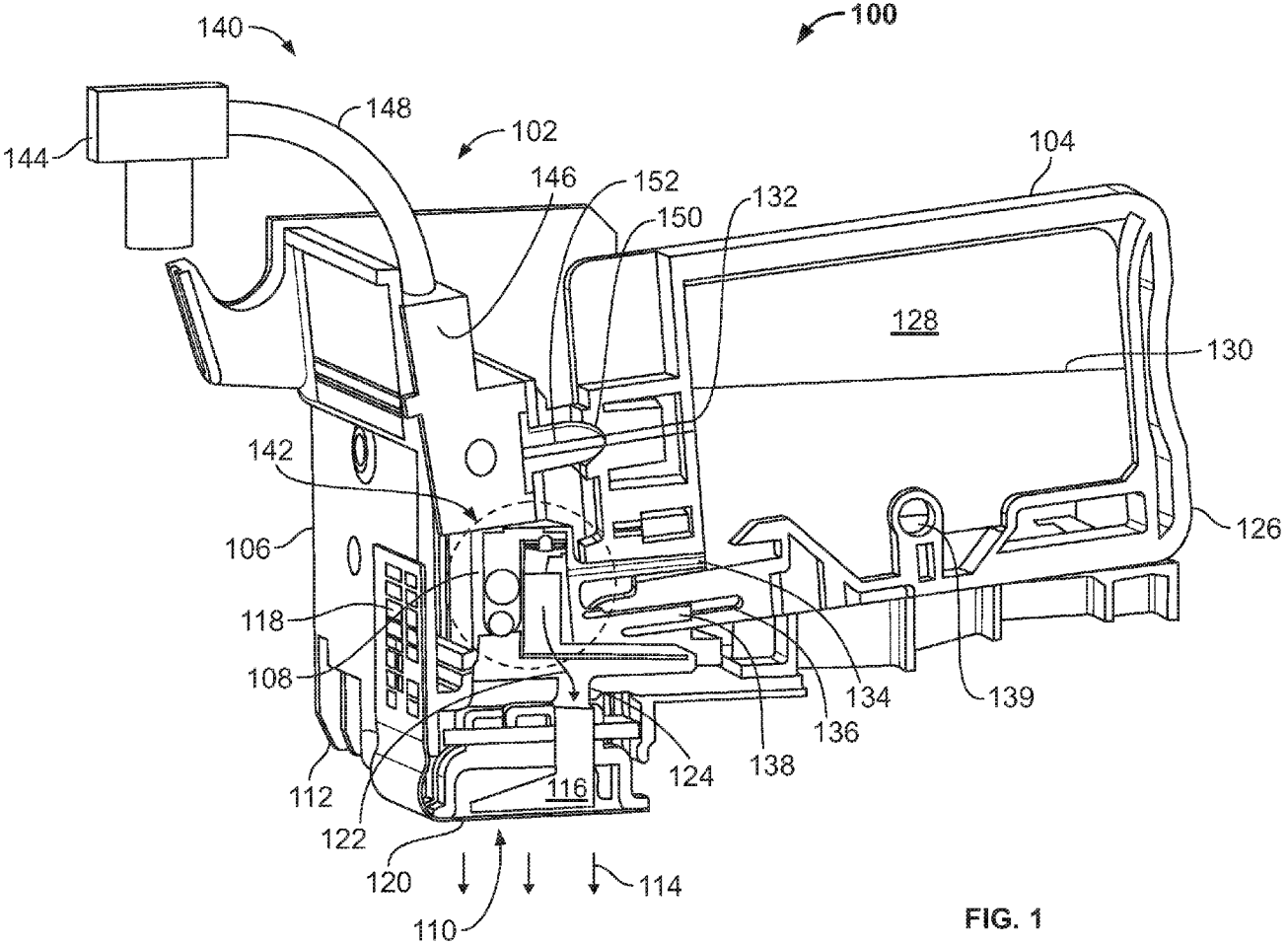
FIG. 1 is a partial, sectional perspective view of an example print cartridge having an air purge system in accordance with the teachings described herein.

Certain examples are shown in the above-identified figures and described in detail below. The figures are not necessarily to scale and certain features and certain views of the figures may be shown exaggerated in scale or in schematic for clarity and/or conciseness. Although the following discloses example methods and apparatus, it should be noted that such methods and apparatus are merely illustrative and should not be considered as limiting the scope of this disclosure. Further, although the illustrated examples described in the figures illustrate an air management system for use with on-axis fluid ejection systems or printing systems (e.g., ink jet printing systems), the example air management systems described herein may also be employed with off-axis fluid ejection systems. Further, while exemplary fluid-jet pen structures are described, the example air management systems described herein may be implemented with other replenishable or replaceable fluid pens, print cartridges, or any other fluid ejection printing system(s) that enable printing on media (e.g., paper).

Some known fluid ejection systems or print systems employ disposable fluid cartridges that have a fluid reservoir or fluid supply integral with a print head mechanism that expels fluid droplets on to a print media. When the fluid reservoir is depleted, the print cartridge along with the print head mechanism is replaced. However, the print head mechanism typically has a significantly longer useful life than the time it takes to deplete the fluid within the print cartridge. Thus, frequent replacement of the print head mechanism may result in higher printing costs.

To enable replenishment of a fluid supply (e.g., an ink supply) without having to replace a print head mechanism, some print cartridges employ a refillable or separately replaceable fluid supply cartridge or reservoir. For example, some known fluid ejection or printing systems employ a free-fluid print cartridge that includes an on-board or on-axis, detachable or replaceable fluid supply or reservoir that can be replaced or refilled as needed. For example, a print head mechanism of the print cartridge may be permanently attached to a printer and the fluid reservoir may be removably attached to the print head mechanism. Additionally, to reduce the size of printers, some known fluid ejection systems employ a print head mechanism that is fluidly coupled to a separate, self-contained fluid supply reservoir that is away from the print head mechanism (e.g., "off-axis" printing).

Using refillable or replaceable fluid supply cartridge can significantly reduce the cost of a fluid ejection system because a fluid supply cartridge or reservoir may be replaced or refilled without requiring replacement of a costly print head mechanism. However, print cartridges having refillable or replaceable fluid supply cartridges are susceptible to excessive air or gas (e.g., air) accumulation within the print cartridge. Excessive air or gas accumulation affects the print quality of the fluid ejection or printing system. For example, excessive air accumulation within the print cartridge may act to restrict flow and may cause print head starvation, thereby preventing the ejection of fluid droplets from the print head mechanism. To purge excessive air or gas accumulation, fluid ejection systems usually employ an air management system.

Some known example print cartridges employ an air management system having a holding chamber to hold or store air or gas accumulated within the print cartridge. The holding chamber is sized based on a predicted amount of gas or air that may be generated over the life of the print head mechanism. However, this air management system requires accurate sizing of the holding chamber based on a predicted accumulation of air or gas over the life of the print head mechanism. However, such an air management system may be inaccurately sized and/or may increase the overall dimensional envelope of the print cartridge assembly.

In other known fluid ejection systems, to remove air or gas from the print cartridge, a known air management system employs push or vacuum priming to push or pull air and gas through the print head mechanism. However, such known methods require frequent priming of the print cartridge, which may result in a significant amount of fluid or ink waste and may affect the quality of the print head mechanism. To purge air or gas from another known fluid ejection system, an air management system employs at least one mechanical valve in combination with a pump. However, such a known system requires a servo motor to mechanically open each mechanical valve and such additional components significantly increase the costs of the fluid ejection system.

Example methods, systems and apparatus described herein overcome at least the foregoing problems and improve an air/gas purging operation of a fluid ejection system while employing a cost-effective air management system. More specifically, the example methods and apparatus described herein provide a printing apparatus or print cartridge assembly having an air management system for removing or purging unwanted air or gas that accumulates in the fluid ejection system.

An example air management system described herein purges air or gas that accumulates in a filter-side chamber (e.g., an area under a standpipe filter) adjacent a print head assembly into an inlet chamber without purging the air or gas via a nozzle of the print head mechanism in fluid communication with the filter-side chamber. The purged air is to be stored in a fluid supply cartridge until the fluid supply cartridge has been depleted and the fluid supply cartridge is replaced or refilled with fluid. To control fluid flow between the chambers, the print head assembly employs a valve system.

An example valve system described herein employs one or more valves that provide a uni-directional purging flow path during an air purging operation. For example, an air management system described herein employs a first valve (e.g., a check valve) to control fluid flow between a filter-side chamber (e.g., a manifold of a print head mechanism) and a return or valve chamber, and a second valve to control fluid flow between the return chamber and an inlet chamber. In particular, during an air purge operation, the first and second valves cooperate to purge air from the filter-side chamber to the inlet chamber via the return chamber. To activate the valve system, the fluid ejection system employs a pressure source (e.g., a pump) to provide a series of pressure pulses during an air purge operation.

Unlike some known air management systems that require periodic or frequent air purging operations to occur prior to a print job after the printer has been idle for a period of time (e.g., a week), the example air management system described herein allows for uninterrupted printing during the life of the fluid supply. In other words, the air management system is activated to purge air or gas from the print cartridge only after a fluid supply has been replenished, replaced or refilled and is not activated again until another fluid supply is once again replenished, replaced or refilled. Reducing the number of air purging operations significantly reduces the amount of fluid waste that would otherwise occur with some known air management systems and maintains a healthy print head mechanism.

Additionally, unlike some known print cartridges, the example valve systems described herein prevent unfiltered ink stored in a fluid reservoir and/or the inlet chamber from flowing to the print head mechanism due to ink sloshing during either a printing operation or during handling or transportation of the print cartridge. Unfiltered ink may have particles or contaminates that may hinder a print head.

FIG. 1 is an example print cartridge 100 for use with a fluid ejection system. For example, the fluid ejection system of the illustrated example is depicted as an ink-jet printing system. The print cartridge 100 of the illustrated example includes a pen assembly 102 and a removable fluid supply cartridge 104 that removably couples to the pen assembly 102.

The pen assembly 102 includes a pen body 106, a pen housing 108 and a print head assembly 110. The print head assembly 110 is coupled to an end 112 of the pen body 106 and expels or ejects fluid droplets (e.g., ink droplets) onto a print media in a direction illustrated by arrow 114. The print head assembly 110 of the illustrated example defines a manifold 116 and includes a flex circuit 118 and an orifice or nozzle plate 120 that has an array of print head nozzles to expel or eject fluid droplets onto a print media. Thermal excitation of ink near the nozzles ejects fluid droplets through the nozzles and onto a print medium. To provide thermal excitation, the nozzle plate 120 may include heating elements such as, for example, resistors, etc. In other examples, other types of ink droplet generators may be employed such as, for example, piezoelectric transducers.

To fluidly couple the print head assembly 110 and the ink supply cartridge 104, the pen body 106 includes the pen housing 108. As described in greater detail below in connection with FIG. 2, the pen housing 108 defines a passageway 122 to fluidly couple the fluid supply cartridge 104 and the print head assembly 110. Further, the passageway 122 of the pen housing 108 is fluidly coupled to the nozzles via the manifold 116 of the print head assembly 110 and a flow channel 124 defined by the pen body 106.

The removable fluid supply cartridge 104 of the illustrated example is an on-board, on-axis detachable reservoir that can be refilled or replaced as needed. More specifically, the fluid supply cartridge 104 is removably coupled to the pen body 106 and can be replaced (or refilled) without having to replace the print head assembly 110. The fluid supply cartridge 104 of the illustrated example has a body 126 defining a fluid chamber or reservoir 128 that holds a fluid supply. The body 126 includes an air inlet channel 132 and a fluid outlet channel 134. To couple the fluid supply cartridge 104 to the pen body 106, the body 126 of the fluid supply cartridge 104 includes a channel 136 to receive a guide or support 138 of the pen housing 108. When the fluid supply cartridge 104 is coupled to the pen body 106, the fluid reservoir 128 is in fluidic communication with the print head assembly 110 via the passageway 122.

To prevent free flow of fluid to the nozzles when the print head assembly 110 is not activated, the fluid jet printing system provides fluid from the fluid reservoir 128 to the print head assembly 110 at a pressure that is lower than ambient atmospheric pressure (e.g., a backpressure or negative pressure). For example, the pressure of a fluid 130 within the passageway 122 is between approximately −10 and −5 inches of water column. Without such a backpressure control mechanism, the fluid 130 may leak or drool through the nozzles onto a printing surface when the print head assembly 110 is in an inactive state.

The fluid supply cartridge 104 of the illustrated example includes a backpressure control mechanism. The fluid reservoir 128 of the illustrated example is a fluid cartridge spring bag having a variable volume, fluid filled bladder that defines a variable reservoir of the fluid supply cartridge 104. To create a negative pressure inside the fluid reservoir 128, a spring, for example, imparts a lateral or outward force on the variable volume fluid reservoir 128 to provide a backpressure (a negative pressure of −5 w.c.). As the fluid 130 is depleted, the fluid reservoir 128 progressively collapses toward a center of the body 126 until substantially all of the fluid 130 has been depleted from the fluid reservoir 128. Also, the spring is to collapse with the fluid reservoir 128 but is calibrated with sufficient spring force to bias the reservoir 128 slightly outwardly to maintain or provide a negative pressure as the fluid is depleted and the reservoir 128 collapses. In some examples, a backpressure mechanism such as, for example, a regulator (a spring loaded lever and bag or spring bag regulator) may be disposed within the pen assembly 102 to regulate the pressure of the pen assembly 102 when the fluid is supplied from an on-axis or off-axis fluid reservoir. For example, in an off-axis configuration, a fluid delivery system (e.g., a reservoir and regulator valve) may be fluidly coupled to the body 126 via an inlet 139, which draws in fluid (e.g., ink). For an on-axis system, the regulator may draw in air via the inlet 139. In other examples, any suitable backpressure mechanism may be employed.

During print job or a fluid supply cartridge change, gas or air may accumulate adjacent the print head assembly 110 or flow channel 124, thereby restricting the ability of the print head assembly 110 to receive and/or deliver fluid to a print media.

To prevent excessive accumulation of air or gas, the pen assembly 102 of the illustrated example employs an air management system 140 that includes a valve system 142. To purge gas or air, the air management system 140 is activated, for example, after the fluid supply cartridge 104 has been replaced with another fluid supply cartridge. To activate the valve system 142 of the illustrated example, the air management system 140 employs a pressure source 144. When the valve system 142 is activated, the valve system 142 purges or returns gas and/or air adjacent the print head assembly 110 to the fluid reservoir 128 as described in greater detail below.

The pressure source 144 of the illustrated example is a pump that is fluidly coupled to the fluid reservoir 128. To fluidly couple the pressure source 144 to the fluid reservoir 128, the pen body 106 includes an air supply manifold 146. The air supply manifold 146 fluidly couples the pressure source 144 to the fluid supply cartridge 104 via tubing 148. A coupler 150 (e.g., a rubber seal) having a passageway 152 fluidly couples the air supply manifold 146 to the air inlet channel 132 of the fluid supply cartridge 104. The coupler 150 of the illustrated example is composed of a rubber material to provide seal between the pen body 106 and the body 126 of the fluid supply cartridge 104.

Figure 2:
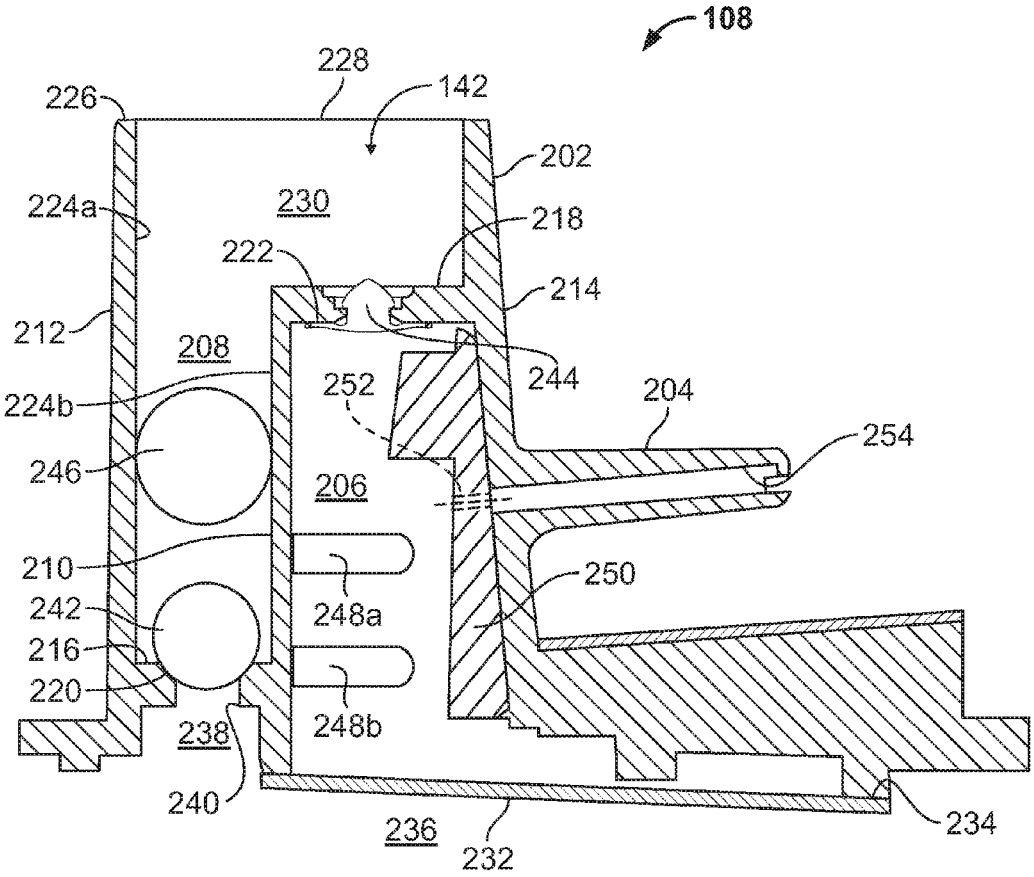
FIG. 2 is a cross-sectional view an example pen housing of the print cartridge of FIG. 1.

FIG. 2 illustrates a cross-sectional view of the example pen housing 108 of FIG. 1. The pen housing 108 includes a body 202 that includes the valve system 142. To fluidly couple the pen housing 108 to the fluid reservoir 128, the pen housing 108 includes a hollow needle 204 adjacent the guide or support structure 138. When the fluid supply cartridge 104 is moved along the guide 138, the needle 204 is inserted or coupled to the fluid inlet channel 134 of the fluid supply cartridge 104.

The body 202 of the pen housing 108 of the illustrated example defines one or more fluid compartments or chambers. The body 202 of the illustrated example defines a first or inlet chamber 206 and a second or return chamber 208. The return chamber 208 is separated from the inlet chamber 206 via a middle or internal wall 210. The internal wall 210 of the illustrated example is disposed between a first outer side wall 212 and a second outer side wall 214. The body 202 also includes a first laterally extending wall 216 extending between the internal wall 210 and the first outer side wall 212 and a second laterally extending wall 218 extending between the internal wall 210 and the second outer side wall 214. The first laterally extending wall 216 defines a first valve seat 220 and the second laterally extending wall 218 defines a second valve seat 222. Thus, the valve seats 220 and 222 of the illustrated example are integrally formed with the pen housing 108 as a unitary piece or structure. Further, an inner surface 224*a* of the return chamber 208 and/or a surface 224*b* of the internal wall 210 may be tapered between the valve seat 220 and an upper end 226 of the return chamber 208.

To prevent fluid from escaping through the body 202, the upper end 226 of the return chamber 208 includes a cap 228. The area of the return chamber 208 between the valve seat 222 and the cap 228 defines an air spring chamber 230. The cap 228 may be a rigid member such as, for example, a plastic cap, a metallic cap, etc. However, in other examples, the cap 228 may be a flexible membrane to provide a variable volume return chamber 208 that expands to enable the air spring chamber 230 to hold more air.

To remove contaminates from the fluid 130, the pen housing 108 employs a porous mesh barrier or filter 232. The filter 232 of the illustrated example is coupled to a lower surface 234 of the pen housing 108 beneath the inlet chamber 206. In particular, the filter 232 of the illustrated example is disposed at an angle relative to first outer side wall 212 of the body 202 and slopes upward toward the return chamber 208. The filter 232 has openings sized to prevent passage of contaminate particles past the inlet chamber 206. The filter 232 of the illustrated example is a mesh screen or membrane fabricated of a material such as, for example, stainless steel or any material that does not react with the fluid 130. For example, the filter 232 may be a stainless steel mesh screen having openings that each have diameters of approximately 10-12 microns.

When coupled to the pen body 106, the lower surface 234 of the pen housing 108 and the filter 232 partially define a filter-side chamber 236 when the pen housing 108 is coupled to the pen body 106. For example, the filter-side chamber 236 is fluidly coupled to the manifold 116 and the flow channel 124.

To collect gas bubbles that form or develop in the filter-side chamber 236 (e.g., the manifold 116 or the flow channel 124), the body 202 and the filter-side chamber 236 defines a gas accumulation area 238 adjacent an inlet 240 of the return chamber 208. For example, the internal wall 210 and the first outer side wall 212 partially define the gas accumulation area 238. The gas accumulation area 238 of the illustrated example is positioned adjacent the inlet chamber 206 and at least partially above the filter 232.

To control fluid flow between the chambers 206, 208 and 236, the pen housing 108 employs the valve system 142. The valve system 142 includes a first valve 242 (a check ball valve) to control fluid flow between the filter-side chamber 236 and the return chamber 208, and a second valve 244 to control fluid flow between the return chamber 208 and the inlet chamber 206. In the illustrated example, the first valve 242 is a check valve and the second valve 244 is a one-way, normally closed valve. More specifically, the first valve 242 is a ball valve composed of a material having a density that is greater than the density of the fluid 130. For example, the ball valve may be composed of stainless steel, plastic or any other suitable material having a density greater than the density of the fluid 130. To limit a travel of the first valve 242, the valve system 142 of the illustrated example also includes a retainer 246 disposed within the return chamber 208 above the first valve 242. In the illustrated example, the retainer 246 is composed of Polypropylene. However, in other examples, the retainer 246 may be composed of stainless steel, plastic, a composite, or any other suitable material(s).

The second valve 244 of the illustrated example is depicted as an umbrella valve. However, in other examples, the second valve 244 may be any other suitable one-way, normally-closed valve. The first and second valves 242, 244 cooperate to purge air that accumulates in the filter-side chamber 236 into the inlet chamber 206 via the return chamber 208 without purging the same via a nozzle of the print head assembly 110.

To detect the level of the fluid 130 within the inlet chamber 206, the pen housing 108 employs one or more fluid sensors 248*a*, 248*b* (e.g., metallic pins). The pen housing 108 of the illustrated example includes a first fluid sensor 248*a* and a second fluid sensor 248*b*. For example, the fluid sensors 248*a*, 248*b* complete an electrical circuit when fluid in the inlet chamber 206 is present. When the fluid level drops below the first fluid sensor 248*a*, an electrical signal is altered due to an increased in resistance in the circuit. The electrical signal is sent to a controller of the fluid ejection system when the level of the fluid 130 in the inlet chamber 206 is at a low level and/or an empty or depleted level. The sensors 248*a*, 248*b* of the illustrated example are electrically coupled to a controller of the fluid ejection system via the flex circuit 118.

To prevent fluid in the inlet chamber 206 from drooling through the nozzles of the print head assembly 110 when the fluid supply cartridge 104 is removed during a supply change, the pen housing 108 of the illustrated example employs the bubble generator or control device 250. The control device 250 is disposed within the inlet chamber 206 and includes an opening 252 in fluid communication with a passageway 254 of the needle 204 and, thus, the fluid reservoir 128. When the fluid supply cartridge 104 is removed, air may flow through the passageway 254 of the needle 204 and causes the pressure within the fluid inlet chamber 206 to increase to atmospheric or ambient pressure, which may cause fluid 130 within the inlet chamber 206 to escape via the nozzles of the print head assembly 110. However, a meniscus of fluid forms across the opening 252 of the control device 250 and a surface tension of the fluid across the opening 252 prevents air flow through the passageway 254 and into the inlet chamber 206 until another fluid supply cartridge is coupled to the pen housing 108. In other words, the meniscus of fluid across the opening 252 acts as a plug to prevent air from flowing into the inlet chamber 206 and, thus, prevents ink drool via the nozzles when the fluid supply cartridge 104 is removed from the pen housing 108.

Additionally, the control device 250 controls the level of the fluid 130 in the inlet chamber 206. In other words, the fluid 130 from the fluid supply reservoir 128 flows into the inlet chamber 206 until the fluid level is substantially aligned with the opening 252 of the control device 250. The opening 252 of the control device 250 of the illustrated example is above the fluid sensors 248*a*, 248*b*.

In the illustrated example, the pen housing 108 is a unitary piece or structure that may be formed via injection molding. The first valve 242, the second valve 244, the retainer 246 and the sensors 248*a*, 248*b* may be assembled or coupled to the pen housing 108. The filter 232 and the cap 228 may then be coupled to the print housing 108 via, for example, bonding, adhesive, welding, etc. The pen housing 108 may then be coupled to the pen body 106 via, for example, adhesive, plastic welding, over molding or any other suitable manufacturing process(es).

Figure 3A:
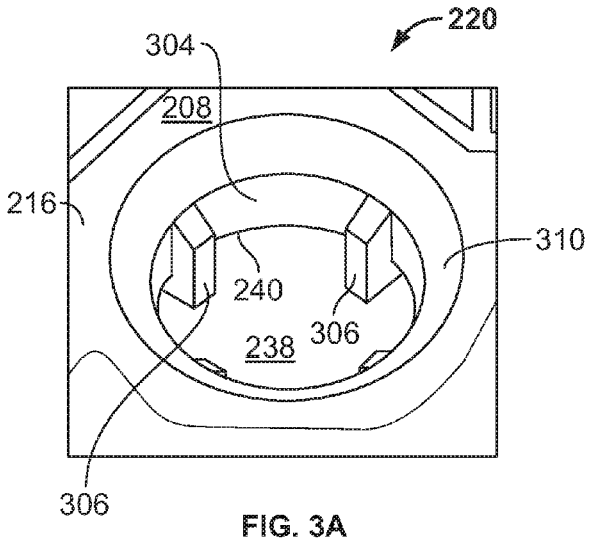
FIG. 3A is an enlarged, view of an example valve seat of the print cartridge of FIGS. 1 and 2.
Figure 3B:
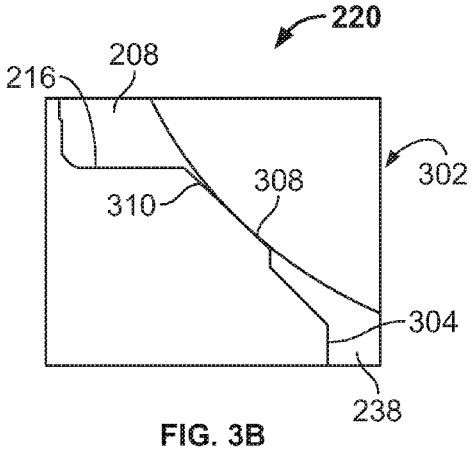
FIG. 3B is an, enlarged partial cross-sectional view of an example first valve of the example print cartridge of FIGS. 1, 2 and 3A shown in a closed position.

FIG. 3A is an enlarged view of the valve seat 220 of the example pen housing 108. FIG. 3B illustrates a portion of the first valve 242 in a closed position 302 relative to the valve seat 220. Referring to FIGS. 3A and 3B, the first laterally extending wall 216 includes an opening or orifice 304 that fluidly couples the filter-side chamber 236 and the return chamber 208. To help promote wetting of the first valve 242, the first laterally extending wall 216 of the illustrated example may include one or more ribs 306 adjacent the inlet 240 of the valve seat 220. Wetting of the first valve 242 enables a more fluid tight seal between a sealing surface 308 (e.g., a chamfered or angled surface) of the first valve 242 and a sealing surface 310 of the valve seat 220 when the first valve 242 is in the closed position 302 to prevent or restrict fluid flow through the orifice 304. As described in greater detail below, a tighter seal between the first valve 242 and the valve seat 220 enables a relatively greater amount of volume of fluid (e.g., ink, air and/or gas) to be purged through the return chamber 208. However, in other examples, the valve seat 220 does not include the ribs 306.

Figure 4:
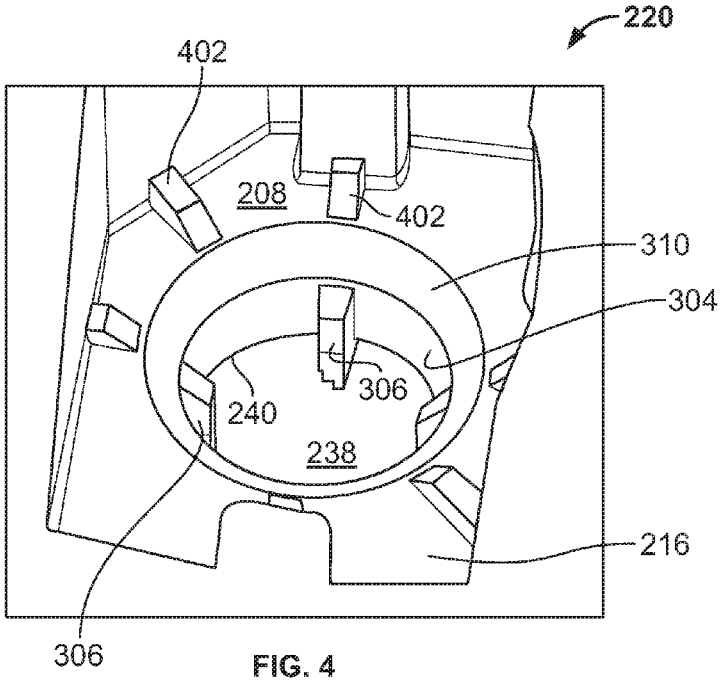
FIG. 4 is an, enlarged view of the example valve seat of FIG. 3A having additional ribs.

FIG. 4 illustrates an enlarged view of the valve seat 220 including ribs 402 adjacent the valve seat 220 in addition to, or instead of, the ribs 306 of FIGS. 3A and 3B. The ribs 402 further help promote wetting of the first valve 242 so that a tighter fluid seal is provided when the first valve 242 engages the valve seat 220 in the closed position 302. In some examples, the pen housing 106 may not include the ribs 402.

Figure 5A:
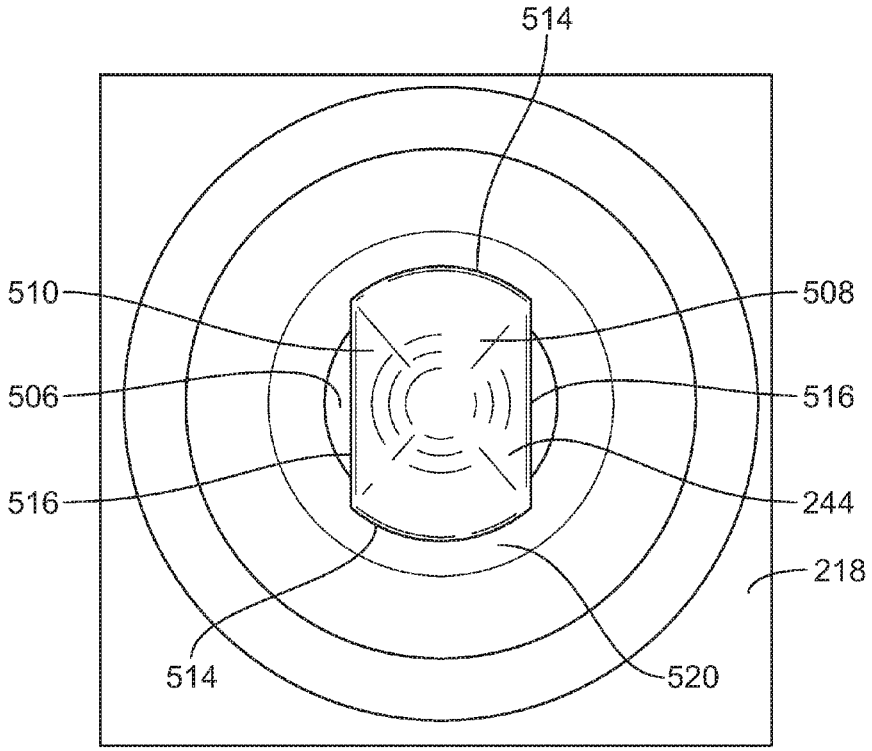
FIG. 5A is a top view of an example second valve of the print cartridge of FIGS. 1 and 2.
Figure 5B:
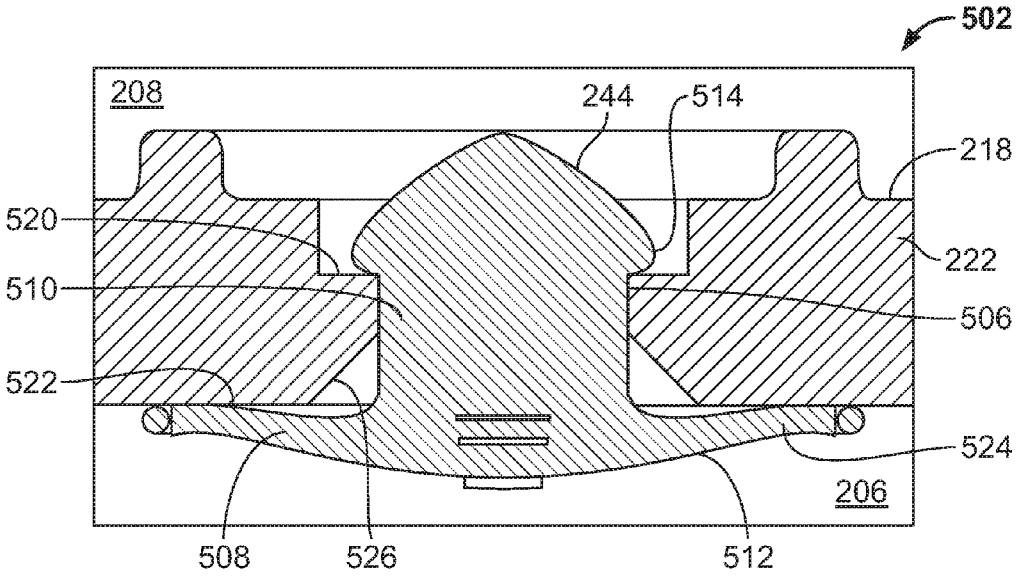
FIG. 5B is a cross-sectional view of the example second valve of FIG. 5A shown in a closed position.
Figure 5C:
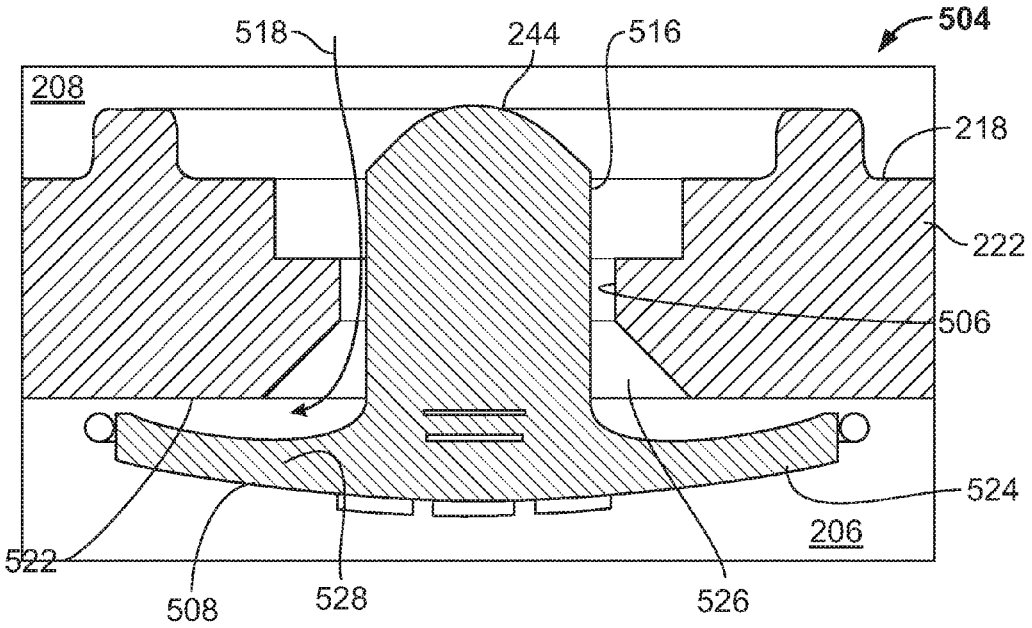
FIG. 5C is a cross-sectional view of the example second valve of FIGS. 5A and 5B shown in an open position.

FIG. 5A is a top view of the example second valve 244 of FIG. 2. FIG. 5B is a cross-sectional view of the second valve 244 shown in a closed position 502. FIG. 5C is a cross-sectional view of the second valve 244 shown in an open position 504. Referring to FIGS. 5A, 5B, and 5C, the second laterally extending wall 218 defines the valve seat 222 to be engaged by the second valve 244. The second laterally extending wall 218 includes an aperture or orifice 506 that fluidly couples the return chamber 208 and the inlet chamber 206. The second valve 244 of the illustrated example is an umbrella valve 508 that includes a stem 510 and a flexible body 512. The stem 510 is an elongated body having a partial peripheral edge or lip 514 adjacent or between flat portions 516. The flat portions 516 provide a fluid flow path depicted by arrow 518 (FIG. 5C) between the stem 510 and the flexible body 512.

The stem 510 of the illustrated example is disposed within the orifice 506 of the valve seat 222. When disposed within the orifice 506, the partial peripheral edge 514 engages an upper surface 520 of the valve seat 222 to retain or couple the second valve 244 to the pen housing 108. When coupled to the valve seat 222, the second valve 244 is in the normally closed position 502 such that the flexible body 512 engages a sealing surface 522 of the valve seat 222. In particular, a length of the stem 510 and a thickness of the valve seat 222 are dimensioned such that a preload is imparted to a peripheral edge 524 of the flexible body 512 when the second valve 244 is coupled to the valve seat 222. The preload provided to the peripheral edge 524 of the flexible body 512 causes the flexible body 512 of the second valve 244 to obstruct or block an outlet 526 of the orifice 506 to prevent or substantially restrict fluid flow across the valve seat 222. The second valve 244 remains in the normally closed position 502 as shown in FIG. 5B when a pressure differential across the second valve 244 is less than an opening or cracking pressure of the second valve 244. Although not shown, the sealing surface 522 of the valve seat 222 or the second laterally extending wall 218 may be polished or smooth to enhance or facilitate sealing to provide a relatively tighter seal between the peripheral edge 524 of the flexible body 512 and the sealing surface 522 of the valve seat 222.

Referring to FIG. 5C, the second valve 244 moves to the open position 504 to allow fluid flow through the orifice 506 when a pressure differential across the second valve 244 is greater than a cracking pressure of the second valve 244. When the second valve 244 is in the open position, the flexible body 512 bends, flexes or bows away from the sealing surface 522 of the valve seat 222. In the open position 504, fluid flows past the flat portions 516 and through the orifice 506 between an inner surface 528 of the flexible body 512 and the valve seat 222 as depicted by arrow 518. When the pressure differential across the second valve 244 is less than the opening or cracking pressure, the preload imparted to the second valve 244 causes the flexible body 512 to return to the closed position 502 of FIG. 5B.

Figure 6A:
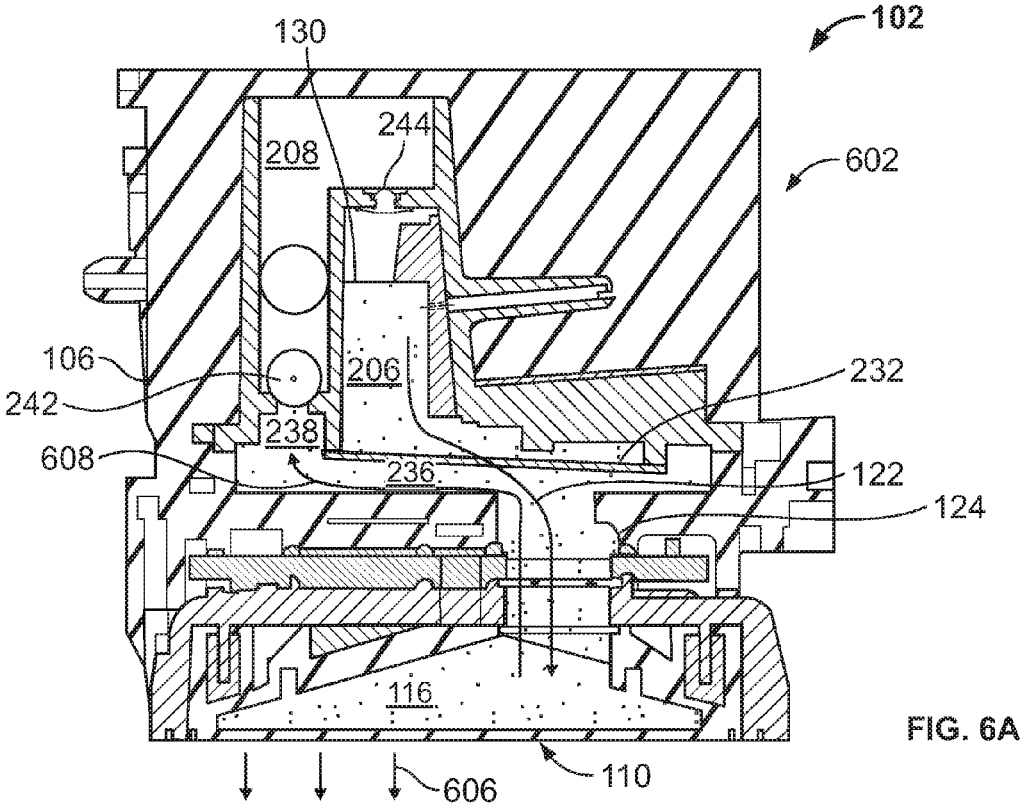
FIG. 6A is a cross-sectional view of the example print cartridge of FIGS. 1 and 2 having an ink supply in a full condition.
Figure 6B:
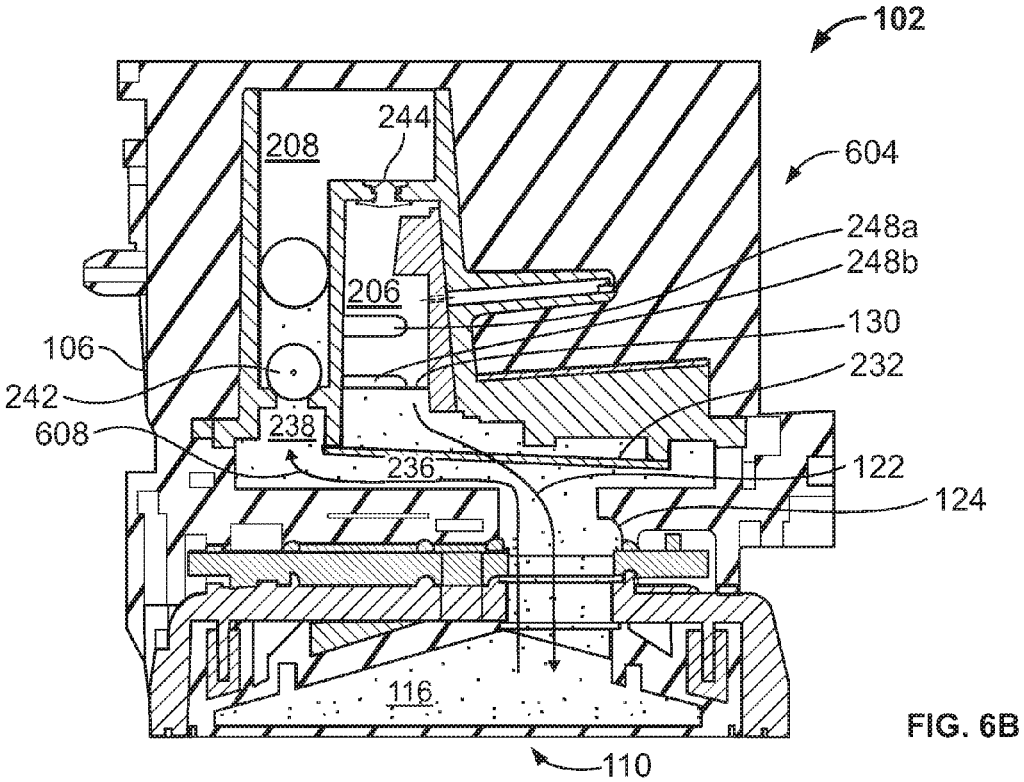
FIG. 6B is a cross-sectional view of the example print cartridge of FIGS. 1 and 2 having an ink supply in a depleted condition.

FIG. 6A is a cross-sectional shape of the pen assembly 102 showing the inlet chamber 206 in a full condition 602 (e.g., substantially filled with fluid 130). FIG. 6B is a cross-sectional shape of the pen assembly 102 showing the inlet chamber 206 in a substantially empty condition 604. For clarity, the fluid supply cartridge 104 of FIG. 1 has been removed from the illustrated examples of FIGS. 6A and 6B.

In operation, a controller activates the nozzles of the print head assembly 110 to expel or eject fluid onto a media traversing below the print head assembly 110. As noted above, the pressure within the inlet chamber 206 and, thus, the manifold 116 of the print head assembly 110 is negative or below atmospheric pressure. For example, the pressure within the pen body 106 may be between negative ten and negative five inches of water column (−10.0 wc to −5.0 wc). To eject a fluid droplet 606 from each nozzle onto a media, a pulse of current is passed through a heating element (e.g., via the flex circuit 118) causing a rapid vaporization of the fluid 130 in the nozzle adjacent the manifold 116 to form a bubble, which causes a large pressure increase to propel the fluid droplet 606 onto the media and drawing fluid 130 from the inlet chamber 206. The surface tension of the fluid, as well as condensation and contraction of a vapor bubble, pulls a further charge of fluid into a nozzle through the passageway 122 fluidly coupled to the fluid reservoir 128.

The fluid 130 may contain dissolved fluid (e.g., gas or air) that outgases in the print head assembly 110 during operation. The fluid travels up to the filter-side chamber 236 or the flow channel 124 via the manifold 116 illustratively depicted by arrow 608. The filter 232 prevents or restricts the gas or air from flowing within the inlet chamber 206. In particular, a meniscus of fluid forms over each aperture of the filter 232 due to the surface tension of the fluid and significantly restricts or prevents air or gas flow through the filter 232 from the filter-side chamber 236 toward the inlet chamber 206. Any gas or air bubbles trapped in the manifold 116 or the filter-side chamber 236 below the filter 232 float upward at an angle toward the gas accumulation area 238.

As shown in FIG. 6B, when the fluid supply is being depleted, air is drawn into the inlet chamber 206, which causes the fluid level to drop. When the fluid level in the inlet chamber 206 is depleted, the fluid ejection system provides an indication via the sensors 248*a*, 248*b* that the fluid supply cartridge 104 is substantially empty. The fluid supply cartridge 104 is removed (or refilled) and a new fluid supply is coupled to the pen body 106. During a fluid supply change, gas or air from the fluid reservoir 128 may pass to the print head assembly 110. Additionally, in some instances, air may pass to the inlet chamber 206 from the orifice 252 (if the orifice 252 is relatively large in size). To remove air and gas within the print head assembly 110, the air management system 140 is activated after a fluid supply change.

Figure 7A:
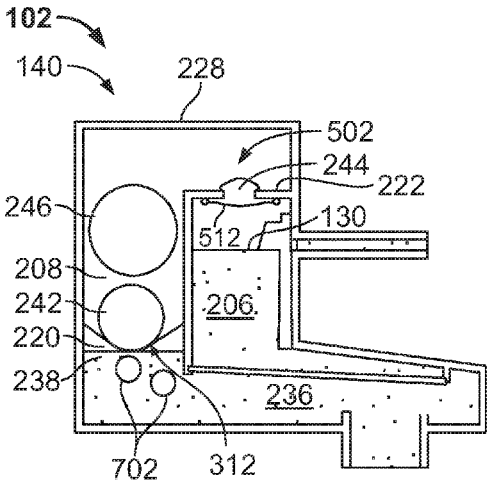
FIGS. 7A-7D illustrate an example fluid purging operation of the example print cartridge of FIGS. 1 and 2.

FIGS. 7A-7D illustrate the operation of the air management system 140 that is activated after a fluid supply change. FIG. 7A illustrates a cross-sectional view of the pen assembly 102 after a fluid supply change. As shown, air or gas 702 may accumulate in the gas accumulation area 238. As noted above, the fluid supply cartridge 104 (FIG. 1) provides a negative or below atmospheric pressure (e.g., −5 wc) within the inlet chamber 206 and the filter-side chamber 236 to prevent the free flow of fluid to the print head assembly 110 (FIG. 1). Also, the pressure in the return chamber 208 is at a negative pressure. When the inlet chamber 206 is under a negative pressure, the first valve 242 is in the closed position 302 to prevent the gas or air 702 from flowing into the return chamber 208. Because the density of the first valve 242 is greater than the density of the fluid 130, the first valve 242 moves to the closed position 302 to engage the sealing surface 310 of the valve seat 220. The second valve 244 is in the closed position 502 to prevent fluid flow between the return chamber 208 and the inlet chamber 206 because the pressure differential (e.g., a zero pressure differential) across the second valve 244 is less than the opening or cracking pressure of the second valve 244.

Figure 7B:
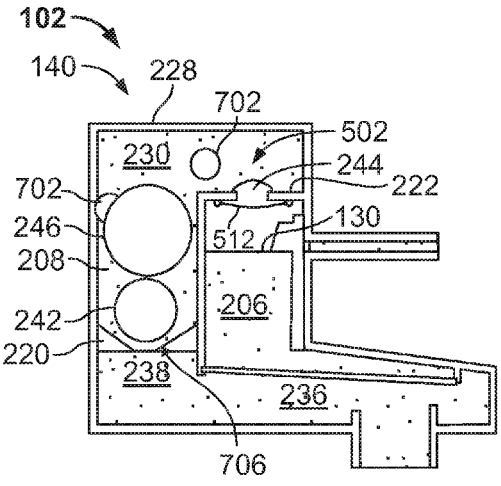

FIG. 7B illustrates the air management system 140 in an activated state. In the activated state, the first and second valves 242, 344 enable air that accumulates in the filter-side chamber 236 to be purged into the inlet chamber 206 via the return chamber 208. When the air management system 140 is activated during a purging operation, the pressure source 144 provides pressure pulses to the fluid reservoir 128 of the fluid supply cartridge 104 via the air supply manifold 146 of FIG. 1. For example, the pressure source 144 pressurizes the fluid reservoir 128 to a pressure of approximately fifty inches of water column (+50 w.c.), which also pressurizes the inlet chamber 206 and the filter-side chamber 236 to, for example, fifty inches of water column.

The increase in pressure of the fluid in the filter-side chamber 236 causes the first valve 242 to move away from the valve seat 220 to an open position 706. In the open position 706, the first valve 242 allows the air or gas 702 in the gas accumulation area 238 to flow into the return chamber 208. Because the pressure in the return chamber 208 is lower than the pressurized filter-side chamber 236 when the first valve 242 initially moves to the open position 706, the air and gas 702 flows into the return chamber 208 until the pressure in the return chamber 208 is approximately substantially similar to, or equalizes with, the pressure in the filter-side chamber 236.

Further, because the pressure in both the return chamber 208 and the inlet chamber 206 are substantially equal when the air and gas 702 flows into the return chamber 208, the second valve 244 remains in the closed position 502 to prevent fluid flow between the pressurized return chamber 208 and the pressurized inlet chamber 206 (i.e., the pressure differential across the second valve 244 is less than a cracking pressure of the second valve 244). Further, the pressure in the inlet chamber 206 acts on the flexible body 512 of the second valve 244 in a direction toward the valve seat 222 to help prevent the second valve 244 from moving to the open position 504. Thus, as pressurized fluid flows into the return chamber 208, the air or gas 702 in the return chamber 208 accumulates in the air spring chamber 230 adjacent the cap 228 and the second valve 244 prevents back flow from the fluid chamber 206 to the return chamber 208. The air or gas 702 compresses when pressurized and accumulates in the return chamber 208 adjacent the cap 228. In the compressed state, the air or gas 702 provides or acts as an air spring.

Figure 7C:
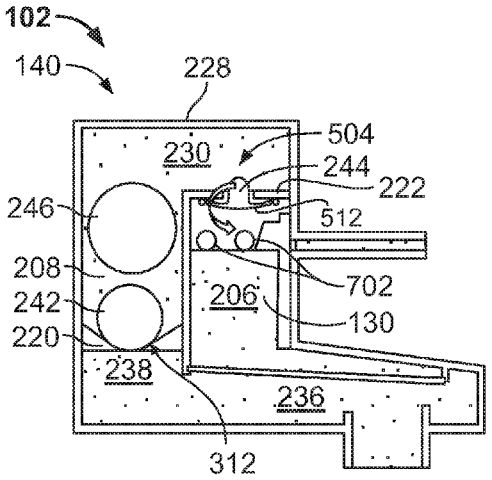

As shown in FIG. 7C, the pressure source 144 is removed after the air or gas 702 in the gas accumulation area 238 has been purged in the return chamber 208. The backpressure regulation mechanism of the fluid supply cartridge 104 causes the pressure in the inlet chamber 206 to return back to the operating negative pressure or pressure below atmospheric pressure (e.g., −5 wc). When the pressure of the fluid in the inlet chamber 206 returns to the negative pressure, the first valve 242 sealingly engages the valve seat 220 and moves to the closed position 302 to prevent or significantly restrict fluid flow (e.g., air, gas, ink) between the filter-side chamber 236 and the return chamber 208. Further, in the closed position 302, the first valve 242 prevents fluid back flow from the return chamber 208 to the filter-side chamber 236. Additionally, the pressurized fluid in the return chamber 208 acts on the first valve 242 to help move the first valve 242 to the closed position 302. Thus, the first and second valves 242, 244 hold pressurized fluid in the return chamber 208 between the first and second valves 242, 244 to provide a pressure differential between the pressurized return chamber 208 and the depressurized inlet chamber 206.

The second valve 244 moves to the open position 504 when the pressure differential across the second valve 244 is greater than the cracking pressure of the second valve 244. In the open position 504, the second valve 244 allows fluid flow from the pressurized return chamber 208 into the depressurized inlet chamber 206 until the pressure differential across the second valve 244 is less than the cracking pressure of the second valve 244. In other words, pressure in the return chamber 208 bleeds off and equalizes with the pressure of the inlet chamber 206 to, for example, −5 wc. The greater the amount of air or gas 702 that is compressed within the air spring chamber 230 of the return chamber 208, the greater the volume of fluid that is purged between the return chamber 208 and the inlet chamber 206 when the second valve 244 is in the open position 504. In particular, as the volume of fluid moves between the return chamber 208 and the inlet chamber 206, the air or gas 702 also moves to the fluid reservoir 128 via the needle 204. Due to its buoyancy, the air or gas 702 will be primarily pulled into the fluid reservoir 128.

Figure 7D:
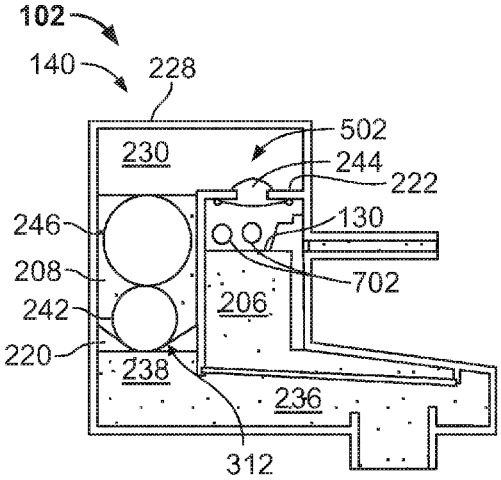

As shown in FIG. 7D, the second valve 244 moves to the closed position 502 when the pressure in the return chamber 208 is once again a negative pressure. Thus, the air or gas 702 from the filter-side chamber 236 is purged to the inlet chamber 206 via the return chamber 208. In particular, the first and second valves 242, 244 enable the air or gas 702 that accumulates in the filter-side chamber 236 to be purged into the inlet chamber 206 via the return chamber 208 without purging the same via a nozzle of the print head assembly 110 (FIG. 1) in fluid communication with the filter-side chamber 236. In other words, the air management system 140 provides a uni-directional closed-loop purging flow path.

FIG. 7D illustrates the print cartridge 100 ready for operation after a purging operation provided by the air management system 140. As shown in FIG. 7D, both the first and second valves 242, 244 are in their respective closed positions 310, 502. Activation of the air management system 140 is not required until a next fluid supply change. Furthermore, the first and second valves 242, 244 remain in the respective closed positions 310, 502 when the air management system 140 is deactivated to prevent unfiltered fluid from within the inlet chamber 206 from traveling to the print head assembly 110 due to the fluid sloshing during operation and/or during handling or shipping of the print cartridge 100.

Figure 8A:
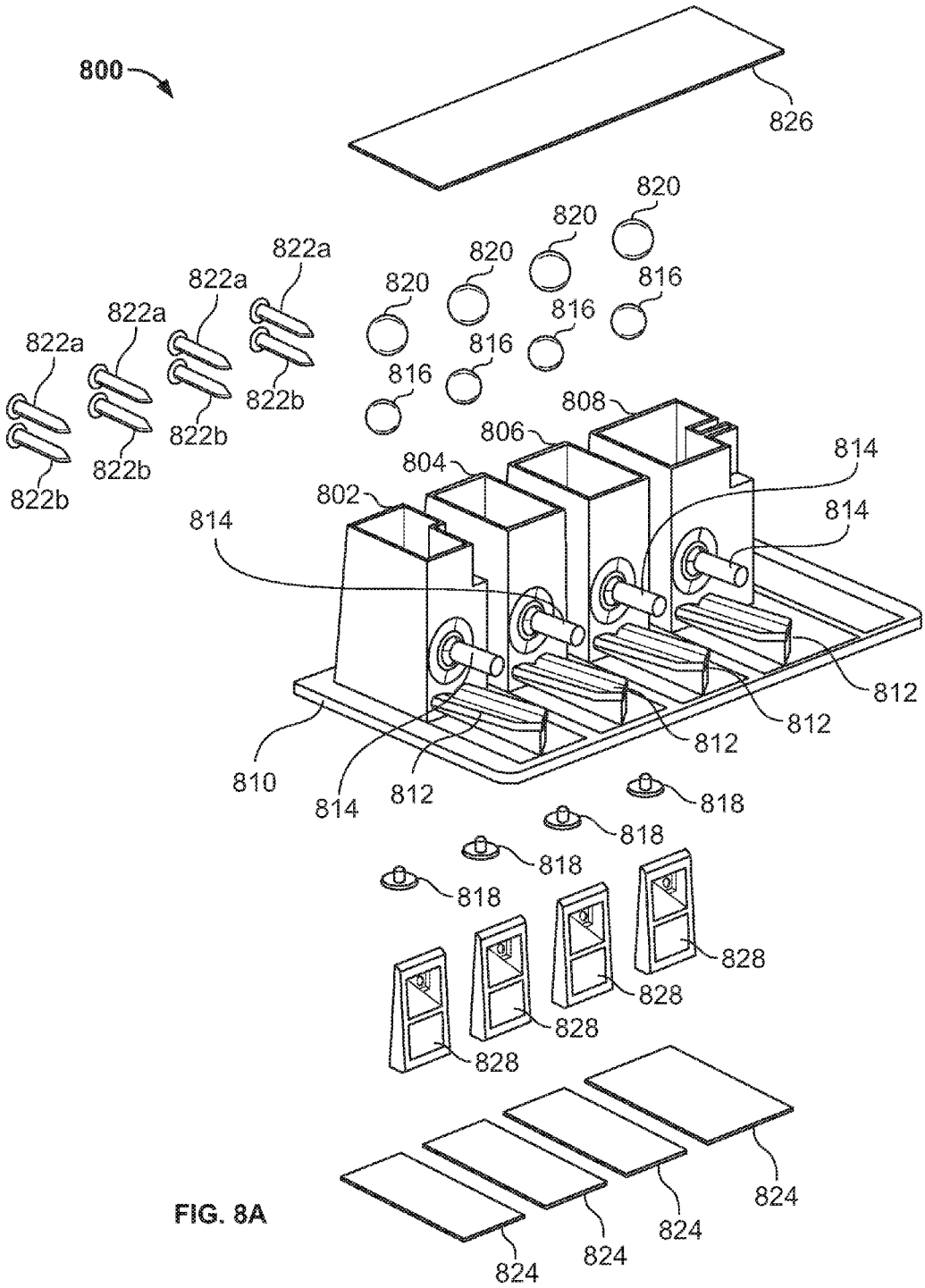
FIG. 8A is an exploded view of another example pen housing assembly described herein that may be used with a fluid ejection system.
Figure 8B:
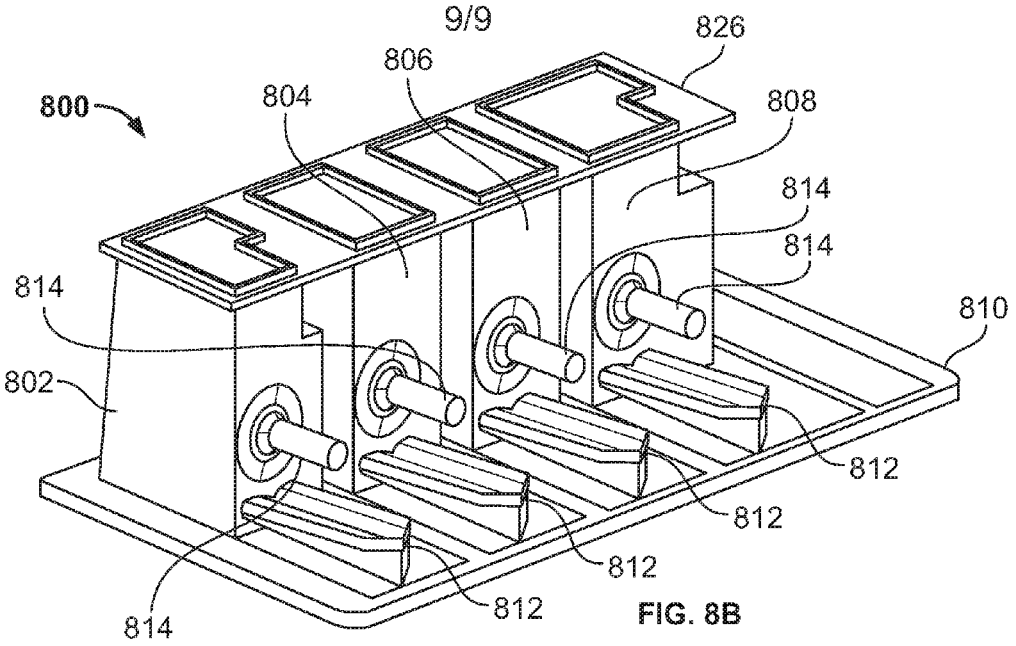
FIG. 8B is an assembly view of the example pen housing assembly of FIG. 8A.
Figure 8C:
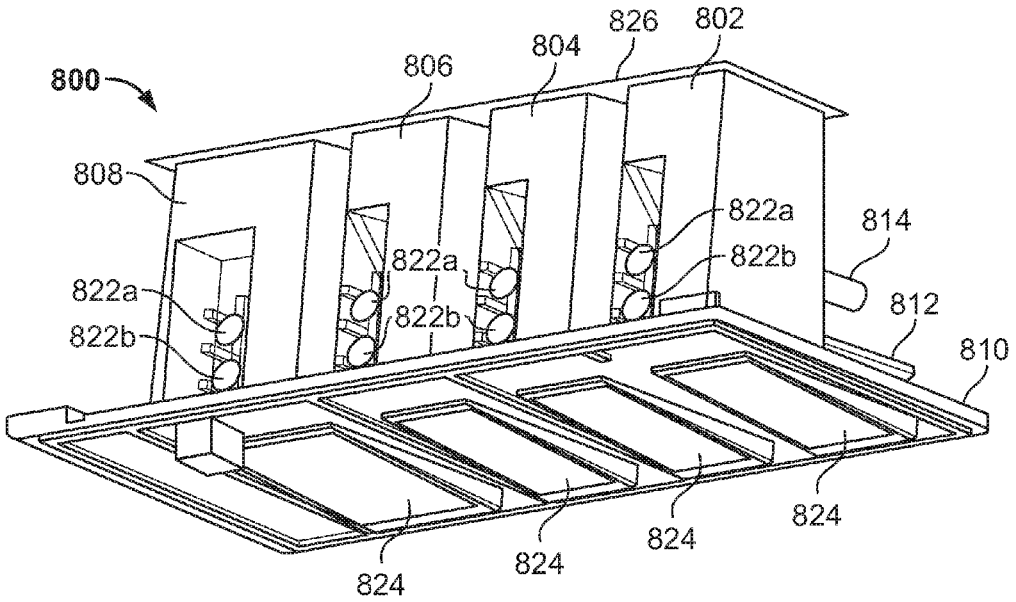
FIG. 8C is another assembly view of the example pen housing assembly of FIGS. 8A and 8B.

FIGS. 8A-8C illustrate an example pen housing assembly 800 described herein that may be used with a fluid ejection system. FIG. 8A illustrates an exploded view of the pen housing assembly 800 and the FIGS. 8B and 8C illustrate different assembly views of the pen housing assembly 800.

The pen housing assembly 800 of the illustrated example includes a plurality of pen housings 802-808 supported by a base 810. Each of the pen housings 802-808 is adapted to be coupled to a pen body (e.g., a pen body 106 of FIG. 1) and a print head assembly (e.g., the print head assembly 110 of FIG. 1). Thus, the pen housing assembly 800 may hold a plurality of fluid supply cartridges (e.g., color inks, black inks, etc.). For example, each of the pen housings 802-808 includes a guide 812 and a hollow needle 814 to receive a fluid supply cartridge (e.g., the fluid supply cartridge 104 of FIG. 1). Thus, the hollow needles 814 fluidly couple respective inlet chambers of the pen housings 802-808 to different fluids such as, for example, black ink, cyan ink, yellow ink, magenta ink, etc. Thus, the pen housing assembly 800 of the illustrated example may hold four fluid supply cartridges.

Each of the pen housings 802-808 is constructed substantially similar to the pen housing 108 of FIG. 2 and defines an inlet chamber (e.g., the inlet chamber 206) and a return chamber (e.g., the return chamber 208 of FIG. 2). The pen housing 808 of the illustrated example is sized larger than the pen housings 802-806 so that the pen housing 808 can hold a larger volume of fluid or ink compared to the pen housings 802-806. In other examples, each of the pen housings 802-808 may have differently sized chambers (e.g., the inlet chamber 206, the return chamber 208) so that each pen housing 802-808 holds a different amount or volume of fluid or ink. Alternatively, each of the pen housings 802-808 may be formed with chambers that may hold substantially the same amounts of fluid or ink. Each of the pen housings 802-808 includes a first valve 816, a second valve 818, a retainer 820, fluid sensors 822*a*, 822*b*, a filter 824, a cap 826 and a control device 828. The cap 826 may be a rigid structure or a flexible membrane that may expand during an air purging operation.

The foregoing description, therefore, should not be construed to limit the scope of the disclosure, which is defined in the claims that follow the description.

The example methods and apparatus described above were developed in an effort to improve the performance of an air management system of in fluid ejection system such as an inkjet printer and to reduce the costs associated with maintaining the print head assembly. Thus, embodiments of the disclosure are described with reference to an air management system for a fluid ejection system. As noted at the beginning of this Description, the examples shown in the figures and described above illustrate but do not limit the disclosure. Other forms, details, and embodiments may be made and implemented. Therefore, the foregoing description should not be construed to limit the scope of the disclosure, which is defined in the following claims.

An example fluid cartridge includes an inlet chamber (206); a return chamber (208) in communication with the inlet chamber (206); a filter-side chamber (236) in communication with the inlet chamber (206) and the return chamber (208); a first valve (242) to control fluid flow between the filter-side chamber (236) and the return chamber (208); and a second valve (244) to control fluid flow between the return chamber (208) and the inlet chamber (206).

In some examples, the first valve (242) is to enable air or gas to flow from the filter-side chamber (236) to the return chamber (208) without escaping through a print head assembly (110) adjacent the filter-side chamber (236). In some examples, the first valve (242) comprises a check valve (242) disposed within the return chamber (208). In some examples, the check valve (242) comprises a ball valve (242). In some examples, the fluid cartridge includes a retainer (246) disposed within the return chamber (208) to limit a travel position of the first valve (242). In some examples, the second valve (244) comprises a one-way, normally-closed valve. In some examples, the second valve (244) comprises an umbrella valve. In some examples, the first valve (242) and the second valve (244) are in a closed position when the pressure in each of the inlet chamber (206) and the return chamber (208) is negative.

In some examples, the first valve (242) is to move to an open position to allow fluid flow from the filter-side chamber (236) to the return chamber (208) when the pressure in the inlet chamber (206) is greater than a negative operating pressure, and the second valve (244) is to remain in a closed position to prevent fluid flow between the return chamber (208) and the inlet chamber (206) when the pressure in each of the inlet chamber (206) and the return chamber (208) is greater than the negative operating pressure. In some examples, the second valve (244) is to move to an open position to allow fluid flow from the return chamber (208) to the inlet chamber (206) when the pressure in the return chamber (206) is greater than the negative operating pressure and the pressure in the inlet chamber (206) is approximately at the negative operating pressure such that a pressure differential between the return chamber (208) and the inlet chamber (206) is greater than a cracking pressure of the second valve (244) to cause the second valve (244) to move to the open position.

An example method of purging a fluid from a fluid cartridge, the method includes pressurizing an inlet chamber (206) to cause a first valve (242) of a pen housing (108) to move to an open position to enable fluid flow between a filter-side chamber (236) and a return chamber (208) of the pen housing (108); and depressuring the inlet chamber (206) to cause the first valve (242) to move to a closed position so that pressurized fluid remains within the return chamber (208) when the inlet chamber (206) is depressurized to provide a pressure differential between the return chamber (208) and the inlet chamber (206) to cause a second valve (244) to move to an open position to allow fluid flow between the return chamber (208) and the inlet chamber (208). In some examples, the method includes disposing the first valve (242) between the filter-side chamber (236) and the return chamber (208), and disposing the second valve (244) between the return chamber (208) and the inlet chamber (206). In some examples, the method includes pressurizing the inlet chamber (206) via a pressure source (144) only after an ink supply change.

An example fluid cartridge assembly includes a housing (202) to define an inlet chamber (206) adjacent a return chamber (208), the inlet chamber (206) and the return chamber (208) being separated by an internal wall (210) of the housing (202), and the inlet chamber (206) and the return chamber (208) being in fluid communication with a filter-side chamber (236) partially defined by the housing (202) when the housing (202) is coupled to the fluid cartridge assembly (100); and a valve system (142) coupled to the housing (202), the valve system (142) having a first valve (242) to control fluid flow between the filter-side chamber (236) and the return chamber (208), and a second valve (244) to control fluid flow between the return chamber (208) and the inlet chamber (206). In some examples, the first valve (242) engages a first valve seat (216) and the second valve (244) engages a second valve seat (218), each of the first and second valve seats (216, 218) is integrally formed with the housing (202). Example valve systems for managing air in a fluid ejection system are described herein. An example valve system includes an inlet chamber (206), a return chamber (208) in communication with the inlet chamber (206), and a filter-side chamber (236) in communication with the inlet chamber (206) and the return chamber (208); first valve (242) controls fluid flow between the filter-side chamber (236) and the return chamber (208), and a second valve (244) controls fluid flow between the return chamber (208) and the inlet chamber (206).

An example print assembly includes an inlet chamber to receive fluid from a fluid supply reservoir fluidly coupled directly to the inlet chamber; a return chamber in communication with the inlet chamber; a filter-side chamber in communication with the inlet chamber and the return chamber; a first valve to control fluid flow between the filter-side chamber and the return chamber; and a second valve to control fluid flow between the return chamber and the inlet chamber, the first valve and the second valve are in a closed position when a pressure in each of the inlet chamber and the return chamber is negative.

In some examples, the print assembly includes a filter to separate the inlet chamber and the filter-side chamber, the filter positioned lower than the first valve and angled upwards towards the first valve. In some examples, at least some of the fluid in the return chamber is drawn through the inlet chamber to the fluid supply reservoir when the fluid supply reservoir is depressurized.

An example print assembly includes an inlet chamber to receive fluid from a fluid supply reservoir fluidly coupled directly to the inlet chamber; a return chamber in communication with the inlet chamber; a filter-side chamber in communication with the inlet chamber and the return chamber; a first valve to control fluid flow between the filter-side chamber and the return chamber; and a second valve to control fluid flow between the return chamber and the inlet chamber, the first valve is to enable air or gas to flow from the filter-side chamber to the return chamber without escaping through a print head assembly adjacent the filter-side chamber.

In some examples, the first valve includes a check valve disposed within the return chamber. In some examples, the check valve includes a ball valve. In some examples, the print assembly includes a retainer disposed. In some examples, the second valve includes a one-way, normally-closed valve. In some examples, the second valve includes an umbrella valve.

An example print assembly includes an inlet chamber to receive fluid from a fluid supply reservoir fluidly coupled directly to the inlet chamber; a return chamber in communication with the inlet chamber; a filter-side chamber in communication with the inlet chamber and the return chamber; a first valve to control fluid flow between the filter-side chamber and the return chamber; and a second valve to control fluid flow between the return chamber and the inlet chamber, the first valve is to move to an open position to allow fluid flow from the filter-side chamber to the return chamber when a pressure in the inlet chamber is greater than a negative operating pressure, and the second valve is to remain in a closed position to prevent fluid flow between the return chamber and the inlet chamber when the pressure in each of the inlet chamber and the return chamber is greater than the negative operating pressure.

In some examples, the second valve is to move to an open position to allow fluid flow from the return chamber to the inlet chamber when the pressure in the return chamber is greater than the negative operating pressure and the pressure in the inlet chamber is approximately at the negative operating pressure such that a pressure differential between the return chamber and the inlet chamber is greater than a cracking pressure of the second valve to cause the second valve to move to the open position.

An example method of purging a fluid from a print assembly, the method includes pressurizing an inlet chamber to cause a first valve of a pen housing to move to an open position to enable fluid flow between a filter-side chamber and a return chamber of the pen housing; and depressurizing the inlet chamber to cause the first valve to move to a closed position so that pressurized fluid remains within the return chamber when the inlet chamber is depressurized to provide a pressure differential between the return chamber and the inlet chamber to cause a second valve to move to an open position to allow fluid flow between the return chamber and the inlet chamber, at least some of the fluid in the return chamber is drawn through the inlet chamber to a fluid supply reservoir coupled to the inlet chamber. In some examples, the first valve is disposed between the filter-side chamber and the return chamber, and the second valve is disposed between the return chamber and the inlet chamber. In some examples, the method includes pressurizing the inlet chamber via a pressure source only after a fluid supply change. In some examples, the method includes pressurizing the inlet chamber by pressurizing the fluid supply reservoir; and depressurizing the inlet chamber by depressurizing the fluid supply reservoir.

An example print assembly, includes a housing to define an inlet chamber adjacent a return chamber, the inlet chamber and the return chamber being separated by an internal wall of the housing, and the inlet chamber and the return chamber being in fluid communication with a filter-side chamber partially defined by the housing when the housing is coupled to a fluid cartridge assembly; a valve system coupled to the housing, the valve system having a first valve to control fluid flow between the filter-side chamber and the return chamber, and a second valve to control fluid flow between the return chamber and the inlet chamber; and a fluid supply reservoir in fluid communication with the inlet chamber and the return chamber, the inlet chamber positioned between the return chamber and the fluid supply reservoir, the first valve to move to an open position to allow fluid flow from the filter-side chamber to the return chamber when a pressure in the inlet chamber is greater than a negative operating pressure, and the second valve to remain in a closed position to prevent fluid flow between the return chamber and the inlet chamber when the pressure in the inlet chamber and the pressure in the return chamber are both greater than the negative operating pressure. In some examples, the first valve engages a first valve seat and the second valve engages a second valve seat, each of the first and second valve seats is integrally formed with the housing.

What is claimed is:

1. A pen housing to provide ink to a printer, the pen housing, comprising:

a first chamber including a first aperture and a second aperture, the first aperture to be coupled to an ink supply;

a second chamber fluidly coupled to the first chamber at the second aperture, the second aperture to flow ink from the first chamber to the second chamber, the second chamber to flow ink to a printhead of the printer;

a filter to cover the second aperture, the filter to deter contaminants from passing from the first chamber to the second chamber, the filter to deter gas from flowing from the second chamber to the first chamber; and a third chamber including a first regulator and a second regulator, the first regulator to control fluid flow between the second chamber and the third chamber, the second regulator to control fluid flow between the third chamber and the first chamber, the first regulator to actuate to enable gas within the second chamber to flow from the second chamber to the third chamber, the second regulator to actuate to enable the gas received from the second chamber to flow from the third chamber to the first chamber.

2. The pen housing of claim 1, wherein the first regulator is actuatable at a first pressure difference between the second chamber and the third chamber, the second regulator is actuatable at a second pressure difference between the third chamber and the first chamber.

3. The pen housing of claim 2, wherein the second pressure difference is greater than the first pressure difference.

4. The pen housing of claim 1, wherein the first regulator is actuatable in response to a pressure increase in the first chamber and the second chamber, the second regulator is actuatable in response to a pressure decrease in the first chamber.

5. The pen housing of claim 1, wherein the pen housing is integral to the printer.

6. The pen housing of claim 1, wherein the first aperture is sized to deter air from entering the first chamber through the first aperture when the ink supply is not coupled to the pen housing.

7. The pen housing of claim 1, wherein the third chamber includes a flexible membrane to enable a volume of the third chamber to change in response to the gas received from the second chamber.

8. The pen housing of claim 1, further including a sensor within the first chamber to detect an ink level within the first chamber.

9. The pen housing of claim 1, wherein the first regulator includes a check ball valve, the second regulator includes an umbrella valve.

10. The pen housing of claim 1, wherein the filter is angled to encourage the gas to accumulate adjacent the first regulator.

11. The pen housing of claim 1, wherein a valve seat of the first regulator includes ribs to reduce a size of an air bubble to pass from the second chamber to the third chamber and to deter the air bubble from becoming lodged at the valve seat.

12. The pen housing of claim 1, wherein the first regulator is a first regulator type and the second regulator is a second regulator type.

13. The pen housing of claim 1, further including a nozzle extending from the fire aperture, the nozzle to be received by the ink supply.

14. The pen housing of claim 13, wherein the nozzle includes a third aperture in communication with the first aperture, the first aperture being smaller than the third aperture to encourage a meniscus of ink to form over the first aperture when the ink supply is not coupled to the pen housing to deter air from entering the first chamber through the first aperture.

15. A method, comprising increasing a pressure within a first chamber to urge ink through a filter that separates the first chamber and a second chamber, the increasing of the pressure to actuate a first regulator that fluidly couples the second chamber and a third chamber to enable gas within the second chamber to flow to the third chamber; and decreasing the pressure within the first chamber to actuate a second regulator that fluidly couples the third chamber and the first chamber to enable the gas to flow from the third chamber to the first chamber.

16. A pen housing, comprising:

a first regulator to actuate in response to a first pressure change to enable gas within a first chamber to flow from the first chamber to a second chamber, the first chamber to flow ink to a printhead, the second chamber to receive ink indirectly from an ink supply; and a second regulator to actuate in response to a second pressure change to enable the gas received from the first chamber to be discharged from the second chamber, the first pressure change being less than the second pressure change.

17. The pen housing of claim 16, further including a filter to separate the first chamber into a first sub-chamber and a second sub-chamber, the gas to be within the second sub-chamber prior to the actuation of the first regulator.

18. The pen housing of claim 17, wherein the filter is to deter contaminants from passing from the first sub-chamber to the second sub-chamber, the filter to deter gas from flowing from the second sub-chamber to the first sub-chamber.

19. The pen housing of claim 16, wherein the first regulator includes a check ball valve, the second regulator includes an umbrella valve.

20. The pen housing of claim 16, wherein the second regulator prevents back flow from the second chamber to the first chamber.

* * * * *